US006373195B1

(12) United States Patent
Whang et al.

(10) Patent No.: US 6,373,195 B1
(45) Date of Patent: Apr. 16, 2002

(54) AC PLASMA DISPLAY PANEL

(76) Inventors: Ki Woong Whang, 11-1307 Woosung 2$^{nd}$ Apartment, Daechi-dong, Kangnam-ku; Cha Keun Yoon, 109-1808 Donga aparnment, 1703 Bongcheon2-dong, Gwanak-ku, both of Seoul (KR)

( * ) Notice: Subject to any disclaimer, the term of this patent is extended or adjusted under 35 U.S.C. 154(b) by 0 days.

(21) Appl. No.: 09/817,128

(22) Filed: Mar. 27, 2001

(30) Foreign Application Priority Data

Jun. 26, 2000 (KR) ..... 00-35372

(51) Int. Cl.$^{7}$ ..... G09G 3/10

(52) U.S. Cl. ..... 315/169.3; 315/169.4; 313/584; 313/585

(58) Field of Search ..... 315/169.3, 169.1, 315/169.4; 313/584, 585, 586, 581, 582

(56) References Cited

U.S. PATENT DOCUMENTS 5,182,489 A 1/1993 Sano ..... 313/485
5,313,223 A * 5/1994 Buzak et al. ..... 345/60
5,341,153 A * 8/1994 Benzschawel et al. ..... 345/152
5,587,624 A * 12/1996 Komaki ..... 313/584
5,659,226 A * 8/1997 Shigeta ..... 313/491
5,825,128 A 10/1998 Betsui et al. ..... 313/582
5,967,872 A * 10/1999 Betsui et al. ..... 445/24
6,198,467 B1 * 3/2001 Chiang ..... 345/132
6,281,628 B1 * 8/2001 Choi et al. ..... 313/585

* cited by examiner

*Primary Examiner*—Don Wong
*Assistant Examiner*—Tuyet T. Vo
(74) *Attorney, Agent, or Firm*—Roylance, Abrams, Berdo & Goodman, L.L.P.

(57) ABSTRACT

The present invention relates to an AC plasma display panel for achieving improved absolute luminance and luminous efficiency at the same time, which comprises a rear substrate formed with separated sub-pixel spaces defined thereon by closed shape barrier ribs for forming color pixels respectively composed of three sub-pixels of red, green and blue phosphor layers disposed in a delta configuration in those sub-pixel spaces, and a front substrate formed with sustain electrodes having projections or wings respectively sticking out or extended over each sub-pixel to face a wing of the neighboring sustain electrode.

11 Claims, 16 Drawing Sheets

AC PLASMA DISPLAY PANEL

BACKGROUND OF THE INVENTION

1. Field of the Invention

The present invention relates to improvements in AC plasma display panels, and more particularly to an AC plasma display panel (referred to hereinafter as "AC PDP") which comprises a rear substrate formed with separated sub-pixel spaces defined thereon by closed shape barrier ribs for forming color pixels respectively composed of three sub-pixels of red, green and blue phosphor layers disposed in a delta configuration in those sub-pixel spaces, and a front substrate formed with sustain electrodes having projections or wings respectively sticking out or extended over each sub-pixel to face a wing of the neighboring sustain electrode thereby achieving improved absolute luminance and luminous efficiency at the same time.

2. Description of the Prior Art

As well known to those skilled in the art, there have been developed a variety of AC PDPs having diagonal sizes that range from about 40 inches to about 60 inches. Where high resolution is to be achieved as in an XGA class AC PDP having 1024×768 pixels, the size of a color pixel shall become smaller than 1 $mm^2$, which requires the effective utilization of its discharge volume. Accordingly, it is essential to develop an AC PDP that has an excellent luminous efficiency by modeling the optimized construction of barrier ribs and the suitable sustain electrodes.

FIG. 1 is a perspective view showing the construction of a conventional AC PDP.

The conventional AC PDP comprises a rear substrate 1 having a dielectric layer 2, a plurality of stripe-structured barrier ribs $\mathbf{14}_1$ to $\mathbf{14}_n$ formed on the dielectric layer to create channels therebetween, a plurality of address electrodes $\mathbf{15}_1$ to $\mathbf{15}_n$ embedded in the dielectric layer 2 while being arranged in parallel and regularly spaced apart from each other and a plurality of red, green and blue phosphor layers 11, 12 and 13 alternately disposed on the surface of the channels between the barrier ribs $\mathbf{14}_1$ to $\mathbf{14}_n$ to create RGB sub-pixels, and a front substrate 3 covering the rear, substrate 1 having sustain electrodes $\mathbf{7}_1$ to $\mathbf{7}_n$ arranged in parallel to each other and perpendicularly to the respective barrier ribs $\mathbf{14}_1$ to $\mathbf{14}_n$ and spaced regularly apart from each other, bus electrodes 6 disposed outside the sustain electrodes $\mathbf{7}_1$ to $\mathbf{7}_n$, black stripes 8 disposed outside the bus electrodes 6, and a protective layer 10, all of which are formed on its inner surface.

In such an AC PDP, the electric discharges of the sustain electrodes $\mathbf{7}_1$, . . . , or $\mathbf{7}_n$ generate ultraviolet light, which excites the corresponding phosphor layer to emit visible light, and thus the visible light is seen through the front substrate 3. As depicted in FIG. 1, the RGB sub-pixels are divided into groups of color pixels of the RGB sub-pixel sets.

In brief, in that conventional AC PDP, the address electrodes $\mathbf{15}_1$ to $\mathbf{15}_n$ are arranged between the respective barrier ribs $\mathbf{14}_1$ to $\mathbf{14}_n$ on the rear substrate to control electric discharges, while the sustain electrodes $\mathbf{7}_1$ to $\mathbf{7}_n$ are disposed on the front substrate 3 to be perpendicular to the address electrodes $\mathbf{15}_1$ to $\mathbf{15}_n$.

Accordingly, this conventional AC PDP has advantages of simple construction of barrier ribs and easy control of discharging in those RGB sub-pixels by using address electrodes.

However, the conventional AC PDP has the disadvantage that the discharge area in a sub-pixel is not effectively utilized because discharges occur only in the center portion of the longish discharge area, having a horizontal width to vertical length ratio of one to three, with the remaining portion being not used.

The Japanese Laid-open Patent Application No. Hei 9-50768 discloses an AC PDP in which a plurality of phosphor-coated sub-pixels are arranged in a delta configuration so as to increase the effective area for luminance. In that AC PDP, meander barrier ribs $\mathbf{18}_1$ to $\mathbf{18}_n$ are formed, with neighboring barrier ribs $\mathbf{18}_n$ and $\mathbf{18}_{n+1}$ being linearly symmetrical to each to vary periodically in width, thus forming a guasi-honeycomb structure on the whole. A plurality of red, green and blue phosphors R, G and B are respectively disposed in a delta configuration in the wider portions 19 of the channels formed by the meander column barrier ribs $\mathbf{18}_1$ to $\mathbf{18}_n$ to create RGB sub-pixels.

However, this AC PDP is not so effective in that the construction of sustain electrodes is not adapted to the shape of RGB sub-pixels for preventing erroneous addressing discharge and two barrier ribs exist between neighboring RGB sub-pixels, though the effective area for luminance is increased.

SUMMARY OF THE INVENTION

Accordingly, the present invention has been made in consideration of the above problems in the prior art PDPs, and an object of the present invention is to provide an AC PDP with improved absolute luminance and luminous efficiency resulting from new and inventive shapes of the RGB sub-pixels and the sustain electrodes.

Another object of the present invention is to provide an AC PDP, in which absolute luminance and color temperature are improved by designing the size and shape of the sustain electrode corresponding to the kinds of phosphors of the respective sub-pixels.

In order to accomplish the above objects and others, the present invention provides an AC PDP, comprising: a rear substrate formed with sub-pixel spaces defined by closed shape barrier ribs for forming color pixels respectively composed of three pixels of red, green and blue phosphor layers disposed in those sub-pixel spaces in a delta configuration and correspondingly designated address electrodes, and a front substrate formed with sustain electrodes having projections or wings respectively extended or sticking out over each subpixel to face a projection or wing of the neighboring sustain electrode.

According to an aspect of the present invention, the length of the projected wing portion of each sustain electrode is within a range of ½ to ⅔ of the length of the respective phosphor-coated sub-pixel region, resulting in optimization of luminous characteristics and discharging capabilities.

According to another aspect of the present invention, each sustain electrode has T-shaped wings, resulting in reduction of the size of the electrode with the length of the part of the electrode for discharging being maintained and the absolute luminous efficiency being improved.

According to still another aspect of the present invention, a sustain electrode may be formed by being laterally extended from an opaque rectangular bus electrode with the thickness of around 40 $\mu$m for improving absolute luminous efficiency.

According to yet another aspect of the present invention, the width of the sub-pixels with the blue phosphor layer is broader than the neighboring sub-pixels with the red phosphor layer, or the lengths of the sustain electrodes vary depending on the kinds of the phosphors coated in the respective sub-pixels, thereby solving the problem that an additional compensation is required for the color temperature which is lowered as white color is tinged with red color owing to the influence of orange color emitted from neon gas and the relatively low luminous efficiency of blue phosphors and the high reduction rate of luminance due to deterioration of the blue phosphors.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Hereinafter, preferred embodiments of the present invention will be described in detail in conjunction with the accompanying drawings.

[First embodiment]

Figure 3:
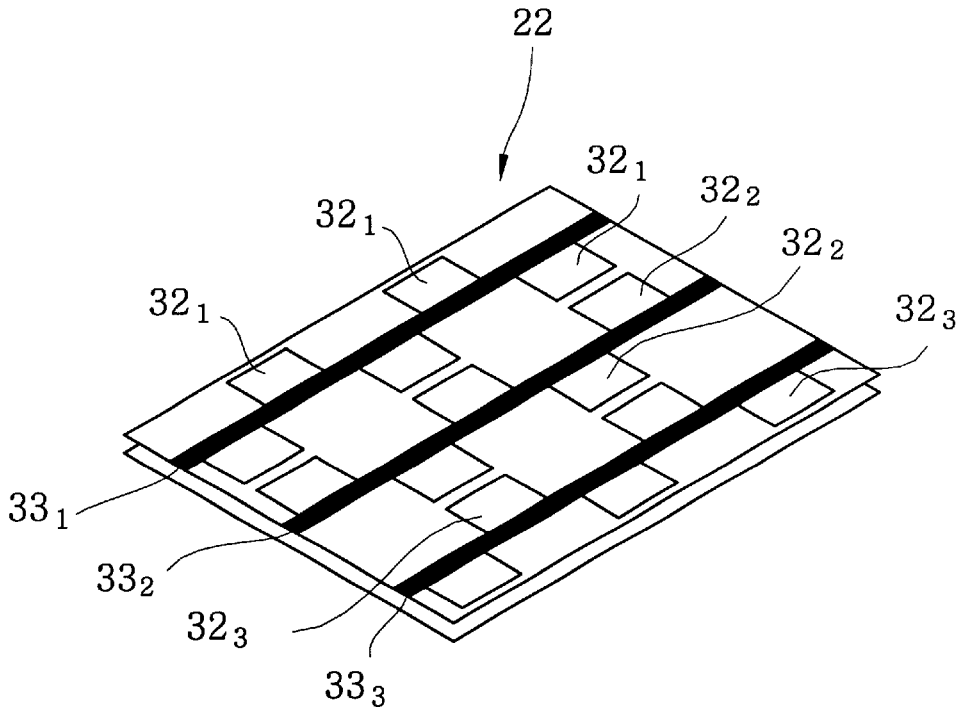
FIG. 3 is an exploded perspective view showing the construction of an AC PDP in accordance with a first embodiment of the present invention.
Figure 3:
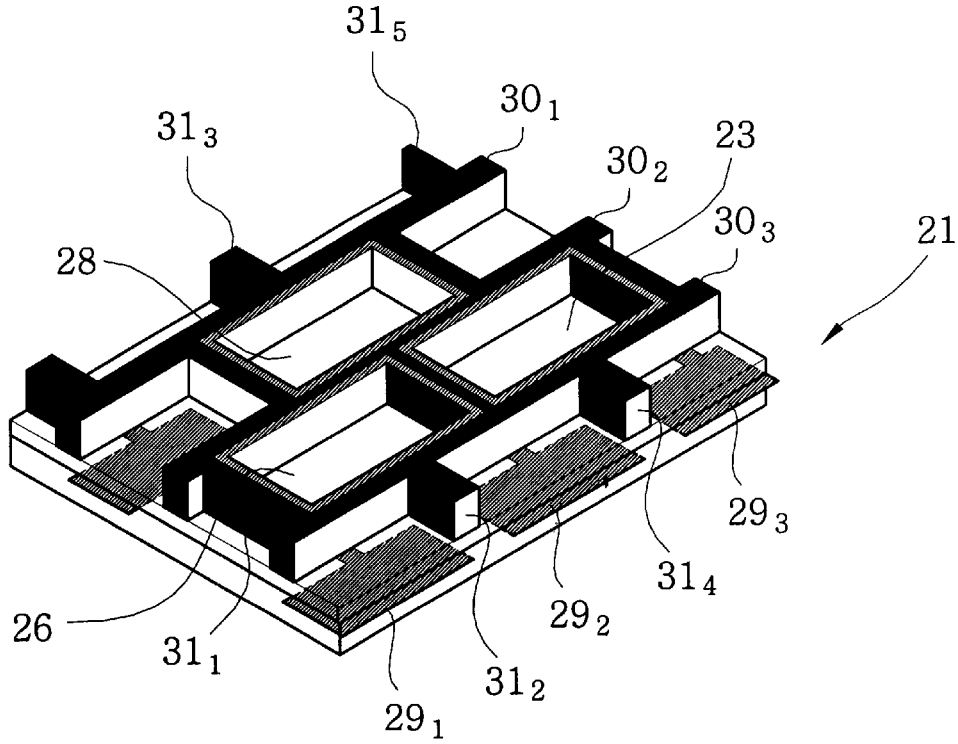

FIG. 3 is an exploded perspective view of an AC PDP according to a first embodiment of the present invention, having the basic structure of the closed shape sub-pixels.

As illustrated in FIG. 3, the AC PDP of this embodiment comprises a rear substrate formed with row barrier ribs $\mathbf{30}_1$ to $\mathbf{30}_3$ arranged in parallel to each other, column barrier ribs $\mathbf{31}_l$ to $\mathbf{31}_4$ arranged in parallel to each other to perpendicularly intersect the row barrier ribs $\mathbf{30}_1$ to $\mathbf{30}_3$, thereby defining rectangular sub-pixel spaces, address electrodes $\mathbf{29}_1$ to $\mathbf{29}_3$ formed under sub-pixel spaces and the column barrier ribs $\mathbf{31}_1$ to $\mathbf{31}_5$, and red, green and blue phosphor layers 23, 26 and 28 respectively disposed on the rectangular sub-pixel spaces in a delta configuration, thus forming delta color pixels, and a front substrate 22 having bus electrodes $\mathbf{33}_1$ to $\mathbf{33}_3$ formed corresponding to and along the row barrier ribs $\mathbf{30}_1$ to $\mathbf{30}_3$, sustain electrodes $\mathbf{32}_1$ to $\mathbf{32}_3$ formed with projected wing portions respectively sticking out over and toward the phosphor-coated sub-pixel regions from the bus electrodes $\mathbf{33}_1$ to $\mathbf{33}_3$.

Figure 1:
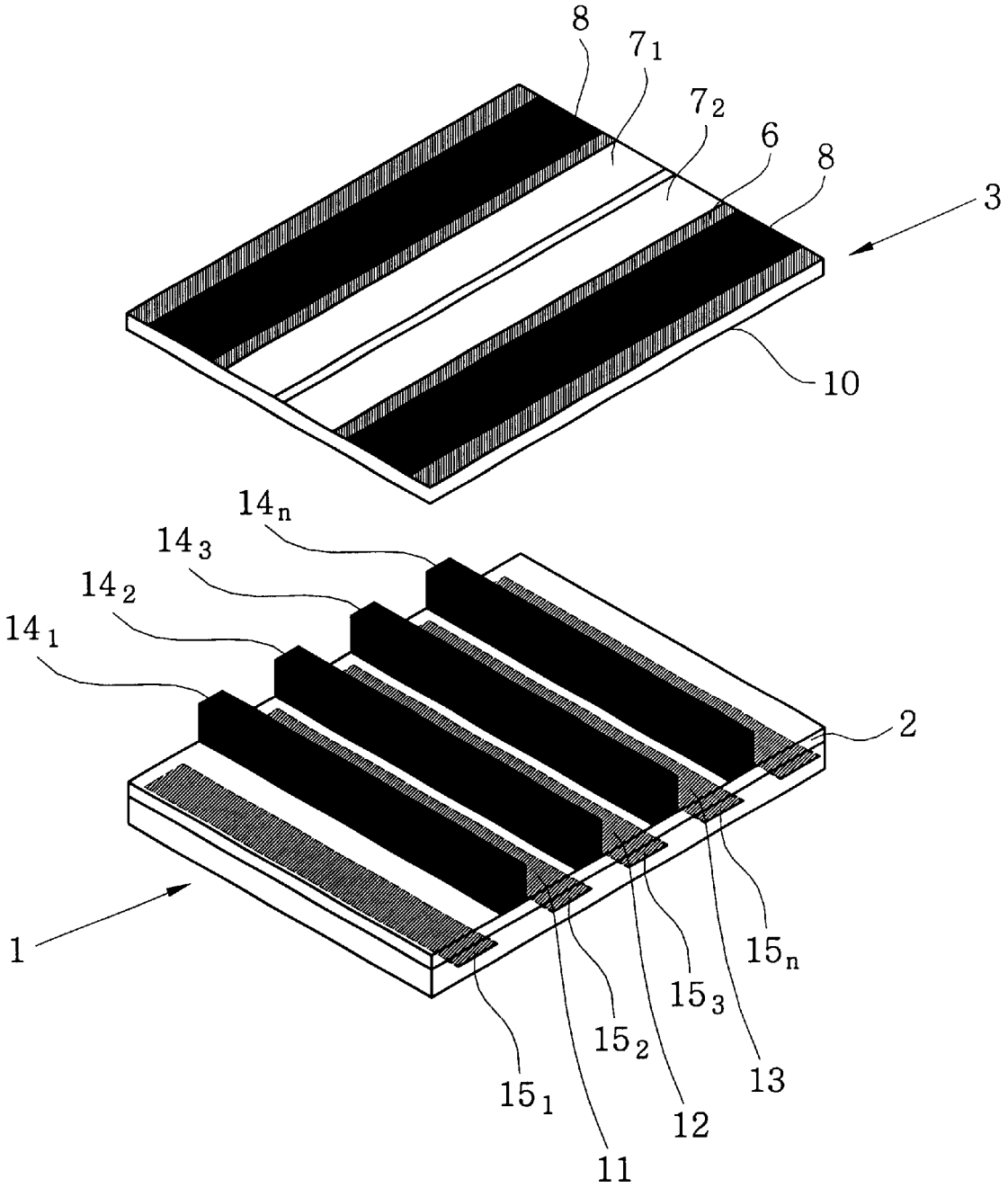
FIG. 1 is a perspective view showing the construction of a conventional AC PDP.
Figure 2:
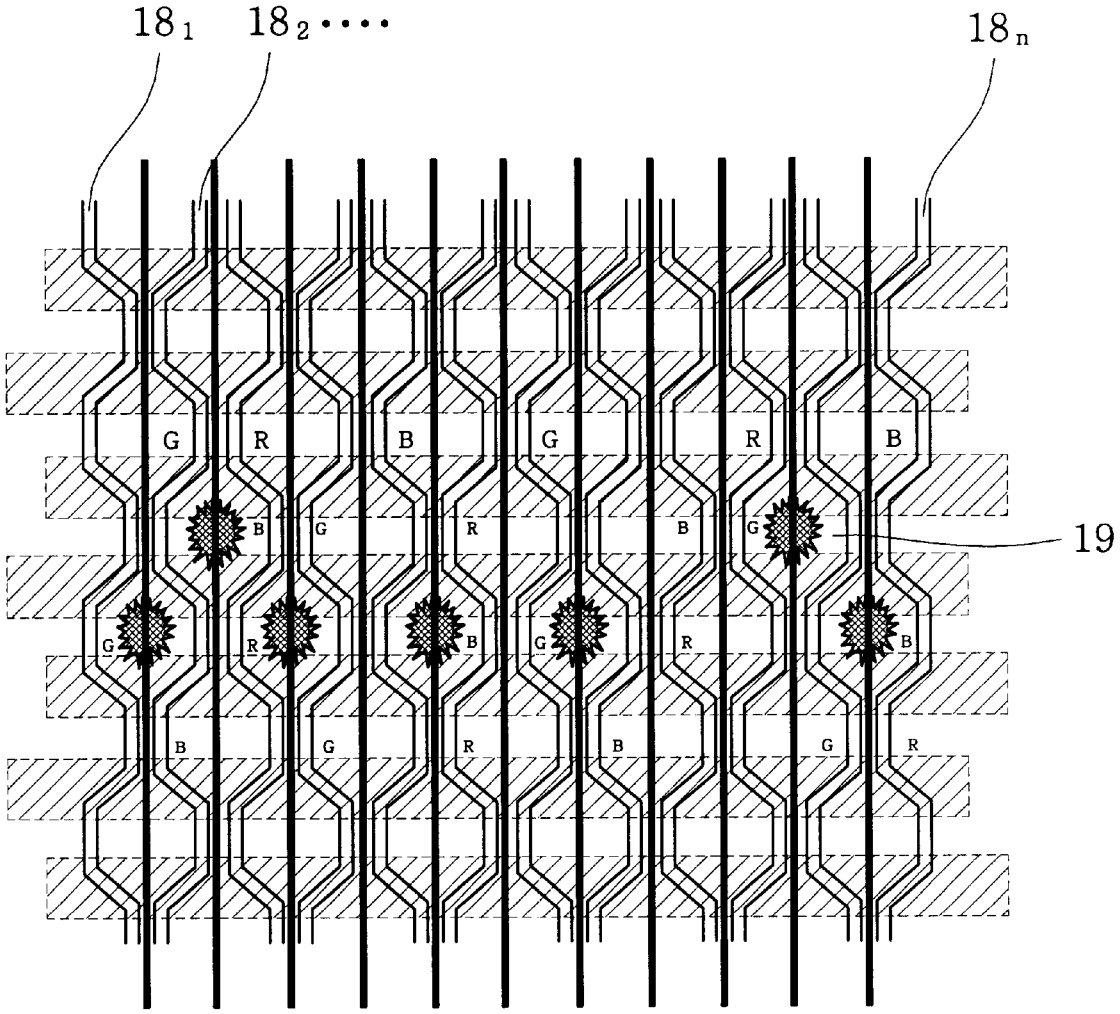
FIG. 2 is a plan view showing the construction of another conventional AC PDP in which RGB sub-pixels arranged in a delta configuration to form respective color pixels.
Figure 4A:
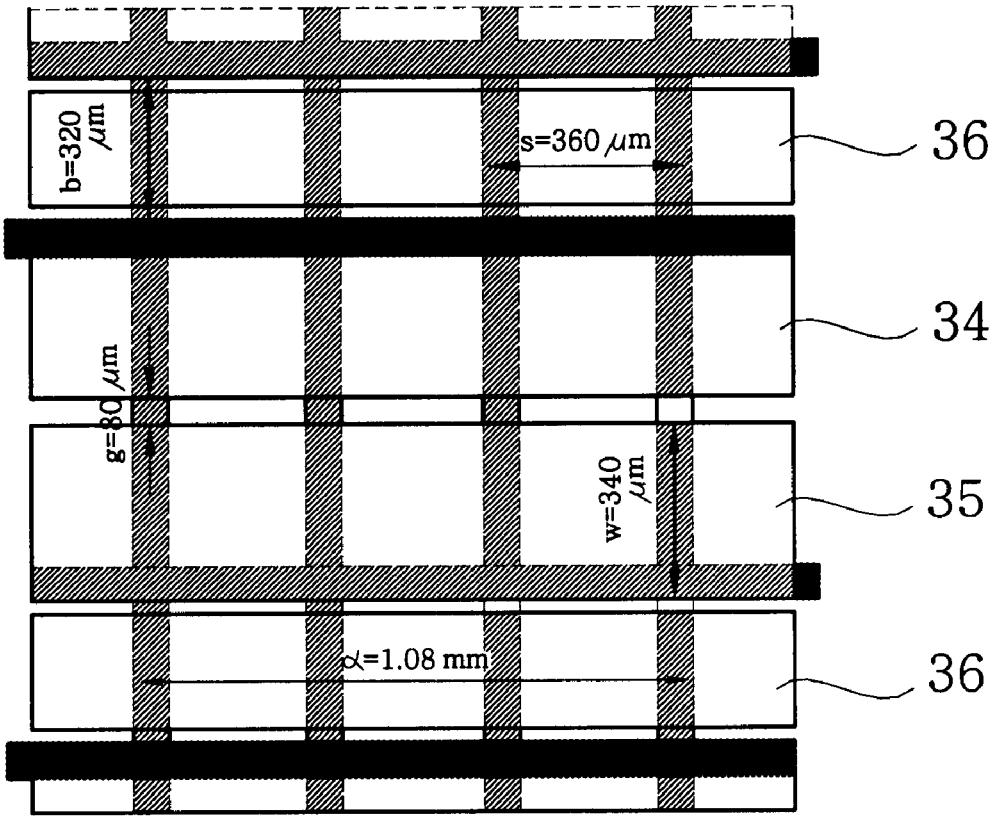
FIG. 4A is a plan view showing the construction of the prior art AC PDP shown in FIG. 1.
Figure 4B:
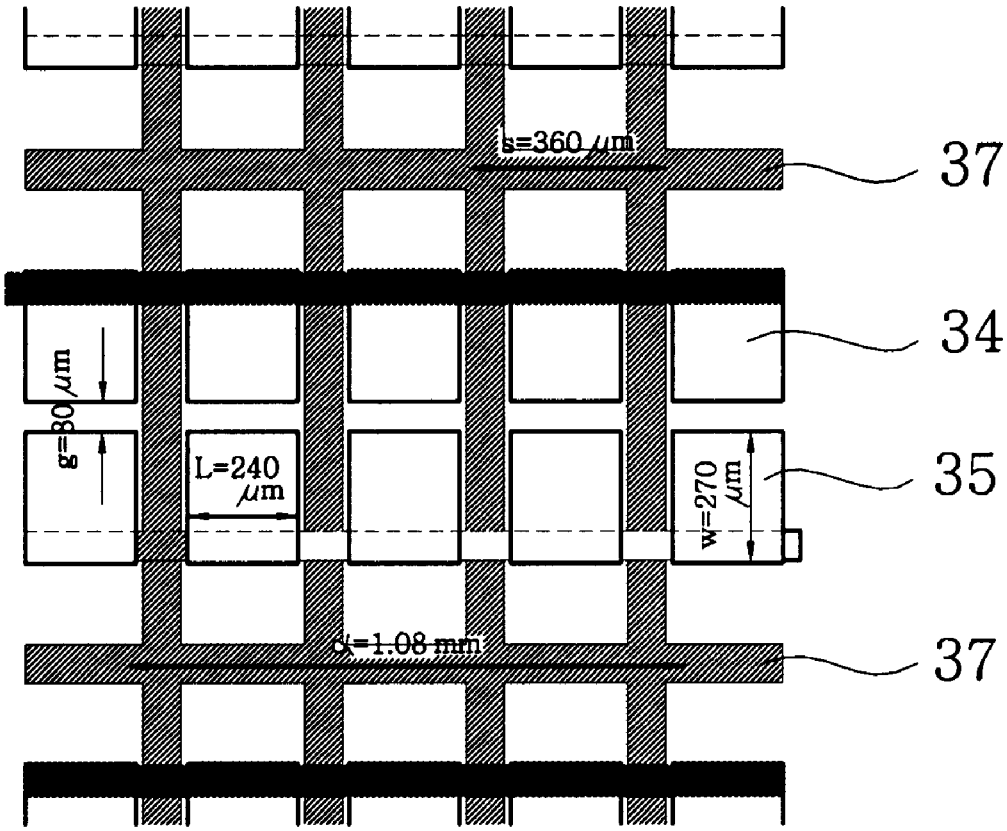
FIG. 4B is a plan view showing the construction of the prior art AC PDP in which black stripes are eliminated from the AC PDP in FIG. 1 and row barrier ribs were added instead.
Figure 4C:
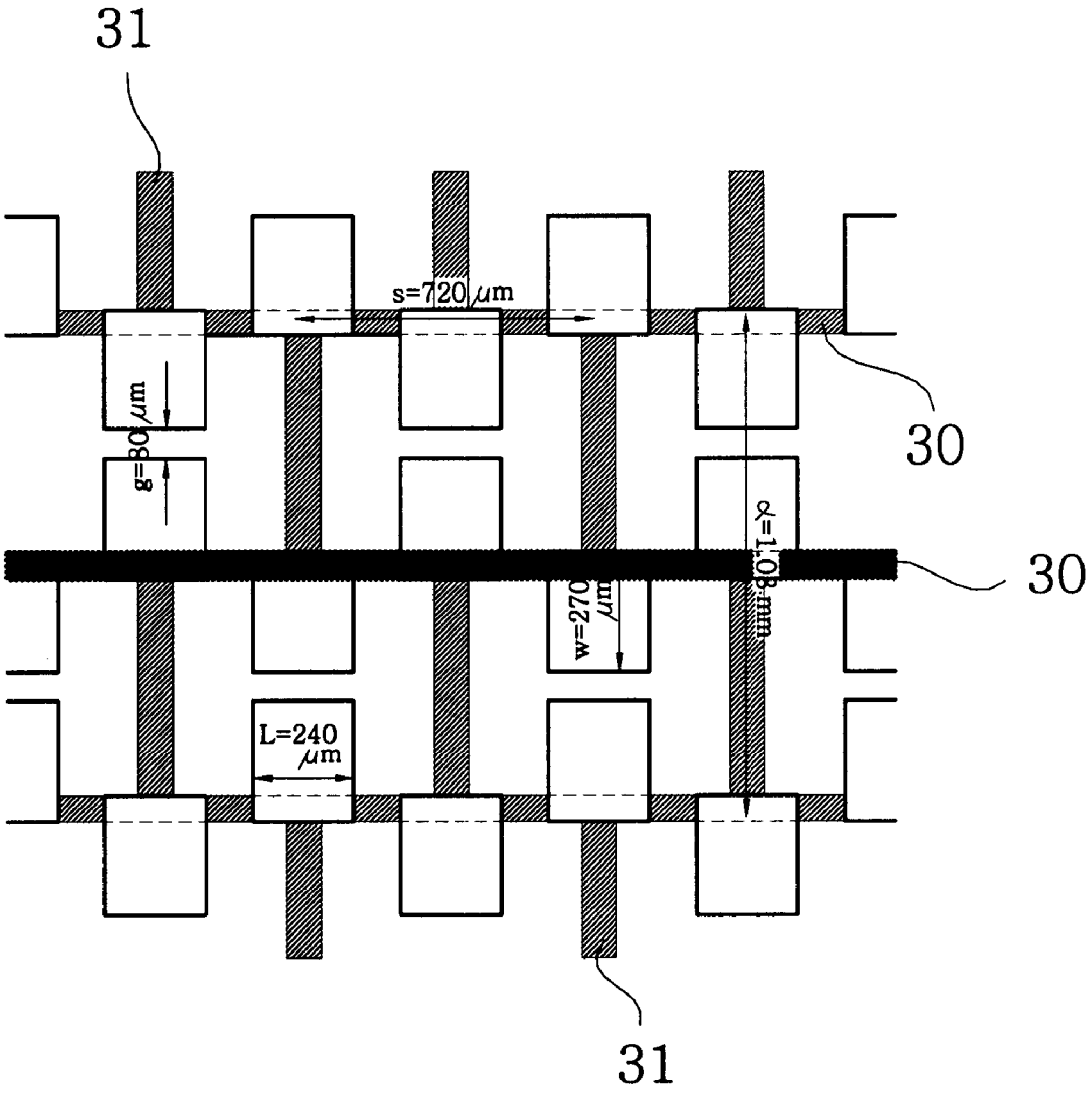
FIG. 4C is a plan view showing the construction of the AC PDP shown in FIG. 3.

FIGS. 4A to 4C are plan views showing the construction of a conventional AC PDP (panel A) shown in FIG. 1, an AC PDP (panel B) in which black stripes are eliminated from the panel A and row barrier ribs were added instead, and the AC PDP (panel C) of the first embodiment of the present invention.

The structures of the panels B and C will be explained in comparison with the Panel A.

All the above PDPs were provided to have the diagonal sizes of forty-inches of VGA class having 640×480 color pixels. The area of a color pixel was 1.08 $mm^2$, the width and height of each barrier rib were respectively 100 $\mu$m and 150 $\mu$m, and the width of each bus electrode was 80 $\mu$m.

In case of the panel A, the width of the sustain electrode 34 or 35 and the gap distance therebetween were 340 $\mu$m and 80 $\mu$m, respectively. Accordingly, a black stripe 36 having a width of 320 $\mu$m was provided between neighboring sub-pixels so as to improve contrast ratio. The sustain electrodes 34 and 35 respectively had a plain, rectangular shape regardless of the construction of barrier ribs on the rear substrate.

The panel B had a construction that the row barrier ribs were added instead of the black stripes in the panel A, thereby separating phosphor-coated sub-pixels from each other. Additionally, for each phosphor-coated sub-pixel, the width and length of each sustain electrode were 270 $\mu$m and 240 $\mu$m, respectively.

The panel C was provided with phosphor-coated sub-pixels with 540 $\mu$m in width and 720 $\mu$m in length and the red, green and blue phosphor-coated sub-pixels were arranged in a delta configuration so as for a set of RGB sub-pixels to form a color pixel. The size of each phosphor-coated sub-pixel and the gap between neighboring sub-pixels were the same as those of the above panels A and B. In this construction, opaque bus electrodes on the front substrate were arranged precisely over the row barrier ribs (38) formed on the rear substrate so that there might be no additional reduction of the opening aperture ratio, differently from the panel B. The transparent sustain electrodes as the projected wing portions of the bus electrodes of the panel C had the same size as those of the panel B, but were arranged to be projected over and toward inside of the corresponding sub-pixels.

As can be seen from the drawings, the size and gap distance of each pair of sustain electrodes in the panel C were the same as in the panel B and portions which were not covered by the sustain electrode are shown on the top and bottom sides of each sub-pixels in the panel B and on the left and right sides of each sub-pixels in the panel C. Accordingly, it will be easily understood that the panels B and C have different discharge characteristics and the length of each sustain electrode in the panel C can be designed up to 720 μm so that the luminance may be further improved in comparison with the panel B.

The luminances and efficiencies of the panels A, B and C were tested under the conditions that only the green phosphors were coated in the sub-pixel spaces and parameters or variables other than the physical construction of the front and rear substrates were set to be the same. Each panel was annealed at the temperature of 300° C. for 2 hours with the rear and front substrates combined together. Then, a discharge gas made by mixing neon with 4% of xenon was injected into each panel under the pressure of 400 torr and the exhaust duct or tube was sealed. Each sealed panel was subjected to a discharge aging process in which a square wave power of 50 KHz with the on-duty 25% was applied for sustaining discharges for 2 hours. The luminance and efficiency were measured utilizing a square wave power of 8.33 KHz with 25% on-duty without a pause period, to minimize the influence of the increase of the temperature of the panel caused by the electric discharge.

Figure 5:
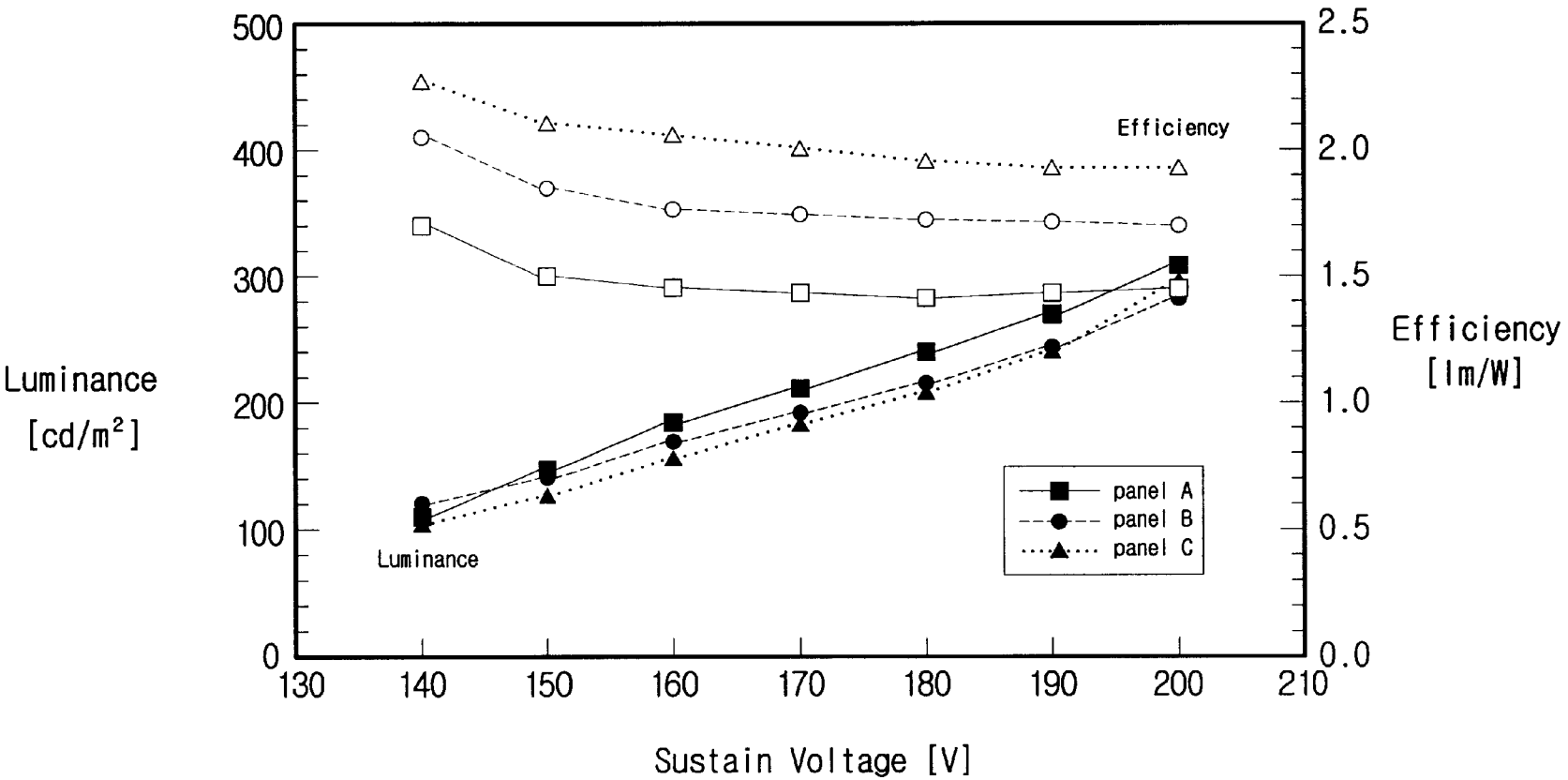
FIG. 5 is a graph showing the luminance and efficiency of the AC PDPs of FIGS. 4A, 4B and 4C measured with the sustain voltage ranging from 140 V to 200 V.

FIG. 5 is a graph illustrating the luminances and efficiencies of the panels A, B and C measured with the discharge sustaining voltages ranging from 140 V to 200 V.

In FIG. 5, black squares indicate the luminances, while white ones show efficiencies. For those three panels, as the sustain voltages are increased, the luminance is increased rectilinearly, while the efficiencies are kept constant after being decreased. At a sustain voltage of 180 V, the luminances of the panels A, B and C are respectively 240.2 cd/m$^2$, 222.4 cd/m$^2$ and 215 cd/m$^2$, and the efficiencies are respectively 1.41 lm/W, 1.72 lm/W and 1.93 lm/W. It is noted that the panel A of the conventional construction has the highest luminance in spite of the black stripes. That's because the area of the sustain electrodes of panel A is larger than the other panels B and C. The area of each sustain electrode wing or projection in each phosphor-coated sub-pixel is 0.2448 mm$^2$ for the panel A and 0.1488 mm$^2$ for the panels B and C. When a reduction in luminance caused by the black stripes is assumed to be 20% in the panel A, luminance per unit area (1 mm$^2$) with regard to the sustain electrodes is calculated to be 1226.5 cd/m$^2$. This value is less than 1494.6 cd/m$^2$ and 1444.9 cd/m$^2$ for the panel B and C. Accordingly, it is important for increasing luminance per unit area to design the shape of the sustain electrodes in such a way that there is no overlapping portion between the sustain electrodes and the column barrier ribs, as in the panels B and C. This is apparent from luminous efficiency calculated by dividing luminance by power consumption.

Though the areas of the sustain electrodes of the panels B and C are the same, the difference in their luminous efficiencies is bigger than that in their luminances. This means that in the panel C relatively little discharge current flows under the same discharge voltage. As shown in FIG. 4, in case of the panel B two neighboring column barrier ribs are positioned right beside the two opposing sustain electrodes, whereas in case of the panel C two neighboring column barrier ribs are shown 200 μm away from the two opposing sustain electrodes. Such a structural difference in the circumference of the discharge area is believed to cause the difference in discharge currents. There exists a big and important differences between the panels B and C that an increase in absolute luminance can be achieved by extending the length of each sustain electrodes to both sides of the discharge area.

As described above, in case of the panel C, its luminous efficiency is increased by 30% and its absolute luminance is decreased by 10% in comparison with the conventional panel A. However, since the sub-pixels of the panel C has a rectangular shape with the length-width ratio of four to three, an additional improvement in luminance can be achieved by increasing the length of sustain electrodes.

The sustain electrodes formed on the front substrate of the conventional AC PDP are arranged in the order of X-Y, X-Y, X-Y, . . . or X-Y, Y-X, X-Y, . . . (X and Y designate respectively a sustain electrode and a scan electrode, while the dash "-" means an electric discharge occurring therebetween), and each pair of the neighboring sustain electrode generate an electric discharge only between them. On the other hand, the sustain electrodes formed on the front substrate of the AC PDP of the present invention are arranged in the order of X-Y-X-Y-X-Y, . . . , and an electric discharge is generated between all the opposing sustain electrodes and utilized for display.

When the above-described arrangement of sustain electrodes is employed while the conventional row barrier ribs are employed, moving images should be displayed in an interlaced addressing scheme and thus deterioration of the image quality is inevitable. However, since the AC PDP of the present invention as described above has the construction that the row and column barrier ribs form the rectangular sub-pixel spaces on the rear substrate and the sustain electrodes do not extend over the column barrier ribs on the front substrate, moving images can be displayed in a progressive addressing scheme.

Figure 6:
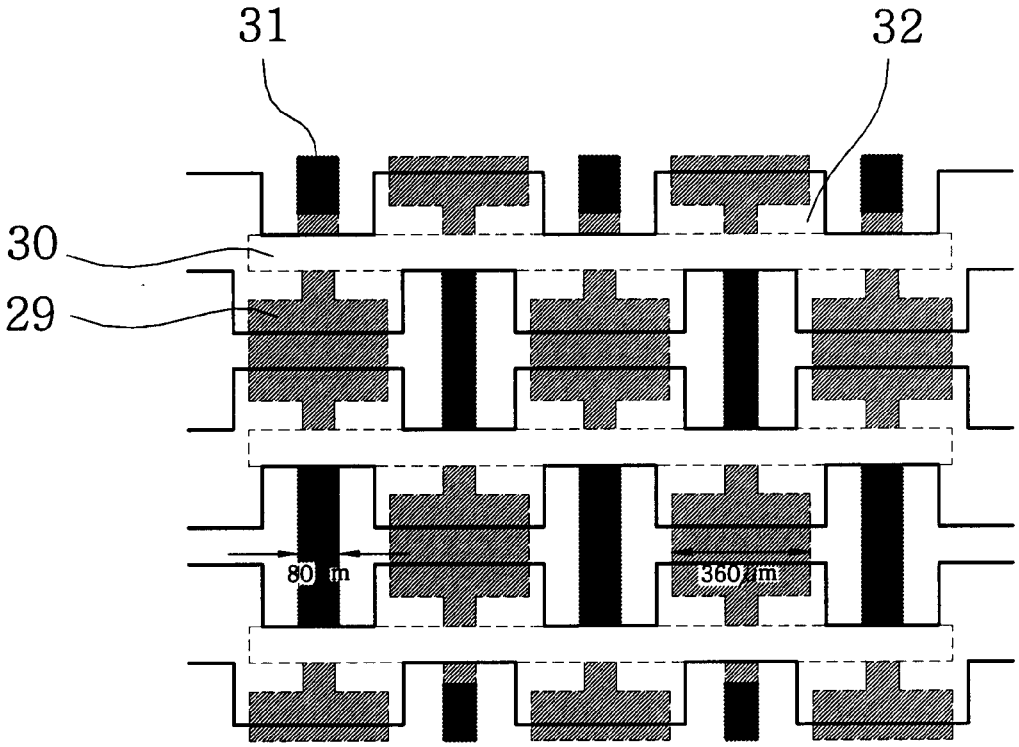
FIG. 6 is a plan view illustrating the construction of the address electrodes used in accordance with the present invention.

FIG. 6 is a plan view illustrating the construction of address electrodes to be applied to the first embodiment of the present invention.

As depicted in the drawing, the inventive address electrodes may have varying widths, depending on its positions in the sub-pixel regions and the column barrier ribs. That is, each of the address electrode has a narrow width of 40 to 80 μm, thereby being completely covered with the corresponding column barrier rib at positions where it passes under the column barrier ribs and should not affect other sub-pixels, whereas it has a broad width of 240 to 360 μm at positions where it passes under the center portions of the sub-pixel regions and addressing is required. As the width of the portions of each address electrode passing under the center portions of sub-pixel regions is designed to be about 3 to 5 times larger than the width of its portions passing under the column barrier ribs, desired addressing can be achieved in the AC PDP according to the present invention.

FIGS. 7A to 7D are plan views showing the revised examples of the AC PDP of the first embodiment according to this invention in which the length of each sustain electrode varies.

The lengths of sustain electrodes were respectively 360 μm, 480 μm, 600 μm and 720 μm for the panels D, E, F and G respectively shown in the FIGS. 7A to 7D.

In the panel G, sustain electrodes cover and traverse the corresponding column barrier ribs. In this case, the longer the lengths of the sustain electrodes become, the larger the absolute areas of the sustain electrodes become. Accordingly, it can be easily understood that the luminance of the AC PDP of the panel G is increased and its efficiency is decreased to some extent.

Figure 8:
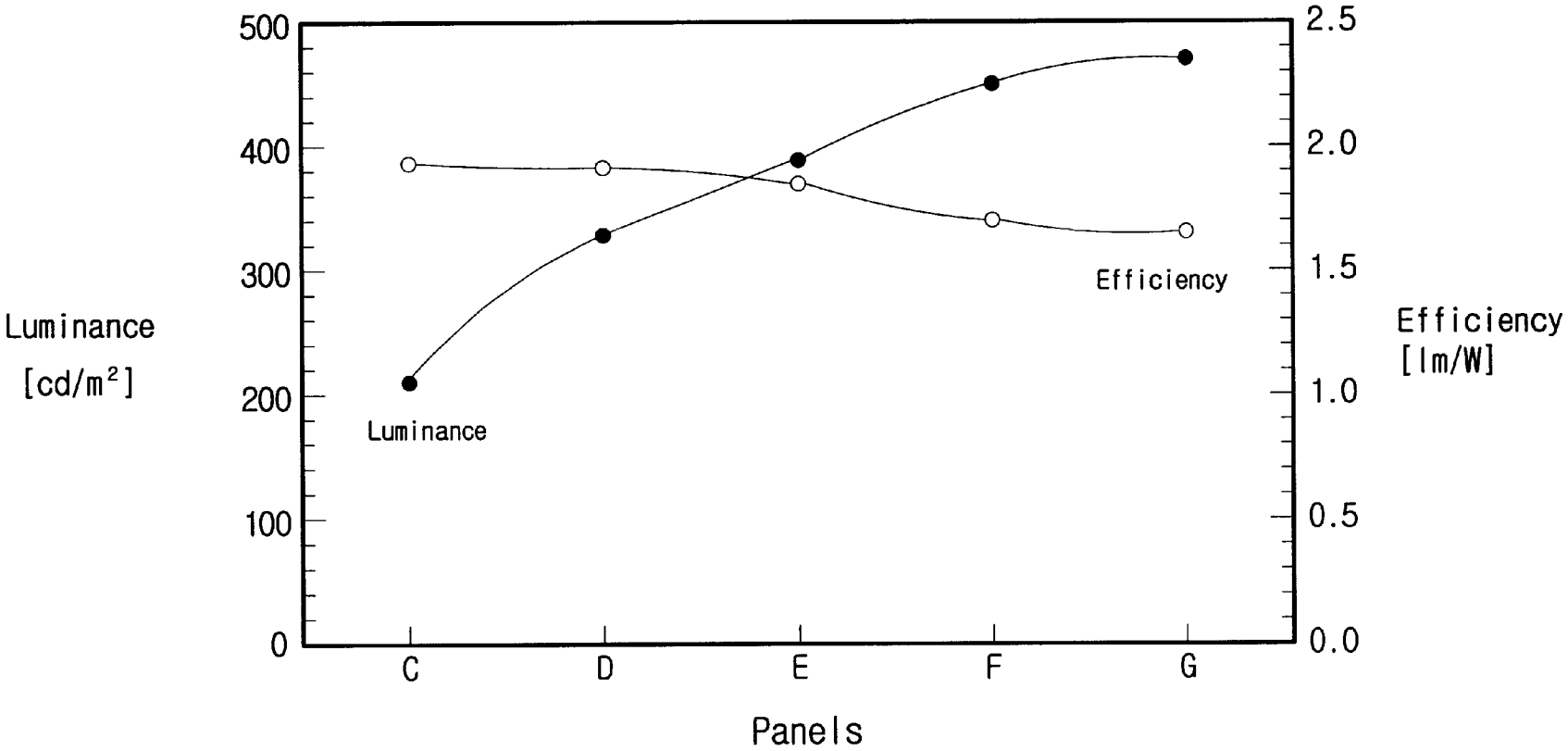
FIG. 8 is a graph showing the luminance and efficiency of the AC PDPs of FIGS. 7A to 7D measured at 180 V of the sustain voltage.

FIG. 8 is a graph showing the luminance and efficiency of the panels C to G measured at the sustain voltage of 180 V.

As can be seen from the drawing, the longer the length of sustain electrodes was made, the greater the luminance of the AC PDP became and the luminance was increased rectilinearly for the panels C, D and E, but the increase rate of the luminance was reduced for the panel G. That is because the portions of the sustain electrodes positions over the column barrier ribs did not contribute to the improvement in luminance but increased the power consumption, thereby reducing the efficiency of discharging. It is noted that the discharge efficiencies were decreased a little for the panels C, D and E, but abruptly for the panels F and G.

Figure 9:
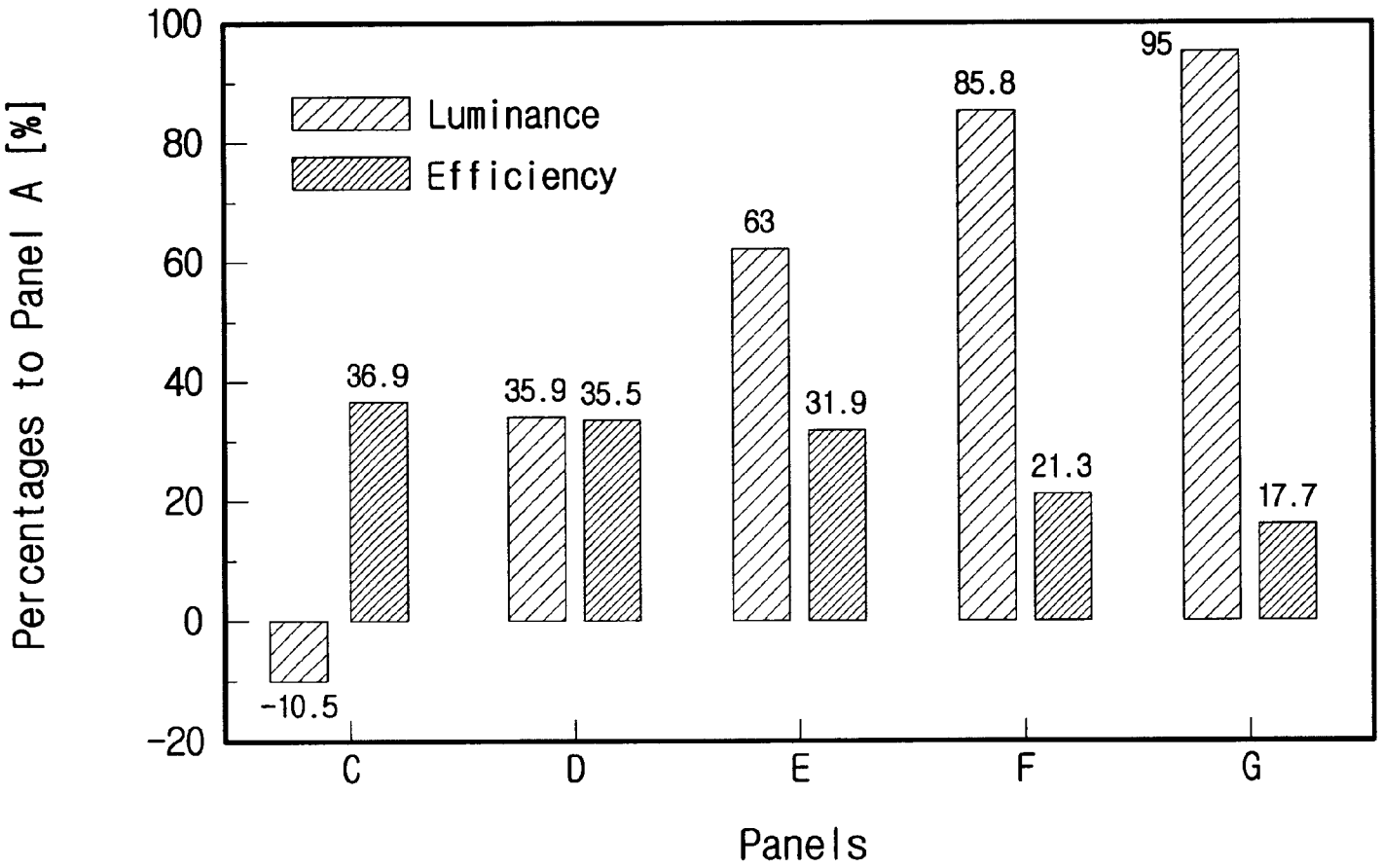
FIG. 9 is a graph in which the luminance and efficiency of the PDPs in FIGS. 4 and 7 are shown to be compared with each other.

FIG. 9 is a graph showing the variation of luminance and efficiency of the panels C to G in percentages in comparison with the panel A.

For the panel C, its efficiency was increased at the biggest ratio, that is, by about 30%, but its luminance was decreased by about 10%. For the panel G, its luminance was increased by about two times, but its efficiency was increased by only about 18%. By the way, it is noted that, for the panels F and G, addressing may not be desirably performed due to their structural characteristics.

As the result, it was confirmed that when each sustain electrode had a length ranging from a half of the length of the sub-pixel(i.e. 720 $\mu$m), i.e., 360 $\mu$m, to two thirds of the length of it, i.e., 480 $\mu$m, the panel optimized in terms of luminance, efficiency and addressing could be obtained.

Figure 10A:
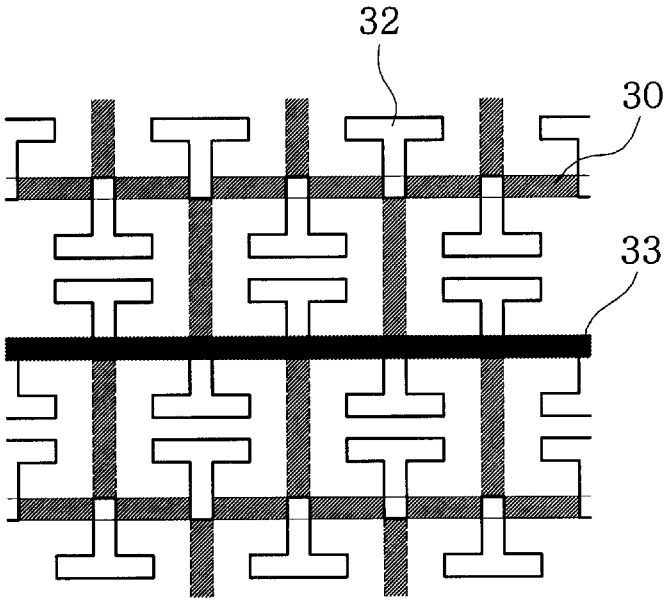
FIGS. 10A and 10B are views showing examples of sustain electrodes for improving the efficiency of the PDP shown in FIG. 7A.
Figure 10B:
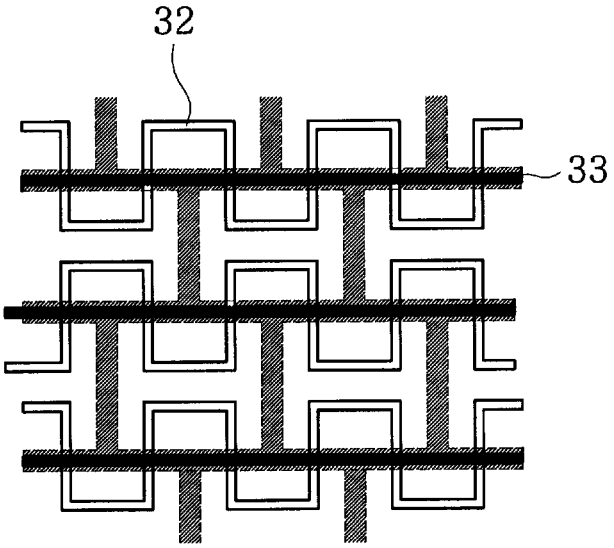

FIGS. 10A and 10B are views showing the construction of sustain electrodes which could improve the efficiency of the panel D shown in FIG. 7.

FIG. 10A shows a way of improving the efficiency of the PDP by making T-shaped sustain electrodes for reducing the areas of the electrodes with the lengths being effective for discharging unchanged.

Recently, in order to improve the permeability of sustain electrodes, there has been proposed a fence construction in which transparent electrodes made of indium tin oxide are eliminated and opaque bus electrodes are employed to have the width of about 40 $\mu$m and fence shape sustain electrode wings are extended therefrom toward and over the sub-pixel regions to face other one extended from the neighboring bus electrode, as illustrated in FIG. 10B.

Figure 11:
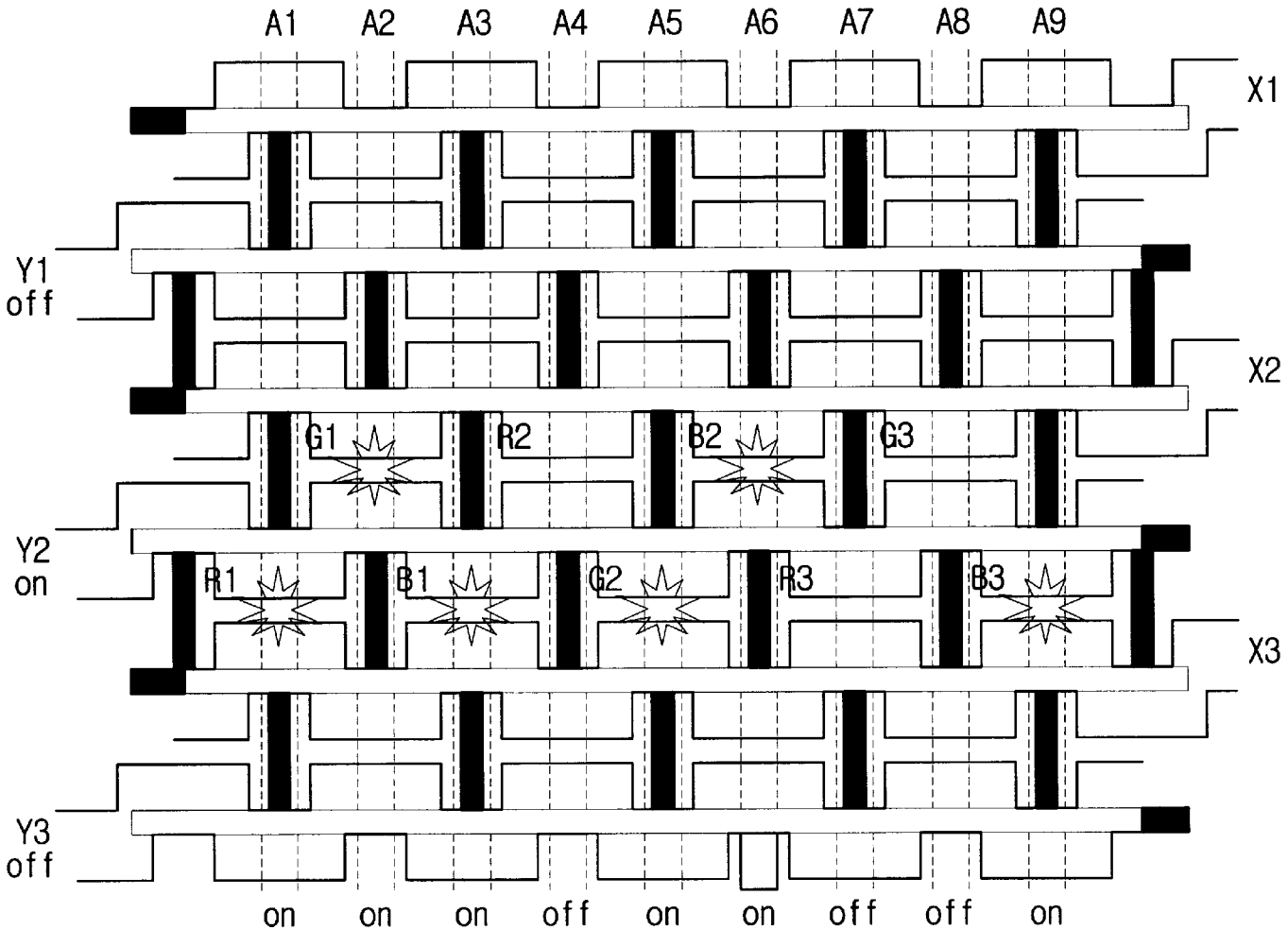
FIG. 11 is a view illustrating the addressing operation of the AC PDP in accordance with the present invention.

FIG. 11 is a plan view showing the addressing operation of the AC PDP of the invention.

Referring to FIG. 11, it is assumed that as a scan voltage is sequentially applied to scan electrodes Y during an addressing period, the voltage is now applied to a scan electrode Y2. Assuming that display signals applied to address electrodes A1 to A9 are those shown under the corresponding electrodes in the drawing, phosphors excited during a sustain period are phosphors R1, G1, B1, G2, B2 and B3, as shown in the drawing. Each address electrode shown in FIG. 11 has a width of 160 $\mu$m and accordingly the parts under a column barrier rib stick out laterally out of both sides of the barrier rib. If the sustain electrodes have the construction of the panel G shown in FIG. 7, non-addressed phosphors may be excited by the scan voltage applied to that address electrode during the sustain period. Particularly, a phosphor R2 should not be addressed because the address electrode A4 is in the state of off, but an addressing discharge may occur between the scan electrode Y2 and the address electrode A3 or between the scan electrode Y2 and the address electrode A5 due to the voltage applied to the address electrodes A3 and A5 in the vicinity of the phosphor R2. However, if the portions of the sustain electrodes opposite to the address electrodes are eliminated by reducing the length of each sustain electrode, the possibility of unintended addressing operation in those sub-pixels will be highly reduced.

In order to ensure perfect addressing operations, it is necessary to provide suitable shape of the address electrodes formed on the rear substrate. That's because unintended addressing discharge can occur, where portions of the address electrodes protrude laterally out of both sides of the column barrier ribs and toward inside of the sub-pixels as explained above. Accordingly, it is required that the address electrodes should be completely covered under the column barrier ribs by designing the address electrodes to have a narrow width. However, when the width of the address electrodes is designed to be excessively narrow, addressing discharge characteristics of the RGB sub-pixels determined in connection with scan electrodes may be deteriorated. Therefore, it is noted that the shape of the address electrodes should be designed in consideration of the above-described matters.

[Second embodiment]

As for the first embodiment of the present invention, there was described the AC PDP in which the shape of each phosphor-coated sub-pixel was different from that of the conventional PDPs and sustain electrodes had the shapes adapted to the sub-pixel shapes. Described will now be a second embodiment of the present invention in which the shape of the rectangular sub-pixel space is revised for the purpose of improving the luminance and luminous efficiency.

Recently, there has been reported a PDP with sub-pixels in an asymmetric configuration in which, in order to improve the color temperature of the PDP, the sub-pixels with red phosphor layer are provided to have a length which is relatively shorter than that of the sub-pixels with blue phosphor layer (Larry F. Webber, "Status and Trends of Plasma Device Research", Euro Display PP, Berlin, Germany, Sept., 6–9, 1999).

This configuration is believed to have structurally solved the problem in a PDP that an additional compensation of the color temperature is required because the white color, which appears when all of the red, green and blue phosphors are maximally excited, is tinged with the red color owing to the influence of the orange color emitted from neon (generally used as a discharge gas), the relatively low luminous efficiency of the blue phosphors and the relatively high reduction rate of luminance by deterioration of the blues phosphors, resulting in lowered color temperature.

This configuration can be applied to the AC PDP of the present invention. Illustrated in FIG. 12 is a second embodiment of the present invention, in which the horizontal length of each blue sub-pixels is longer than that of the laterally adjacent red sub-pixels.

Figure 12:
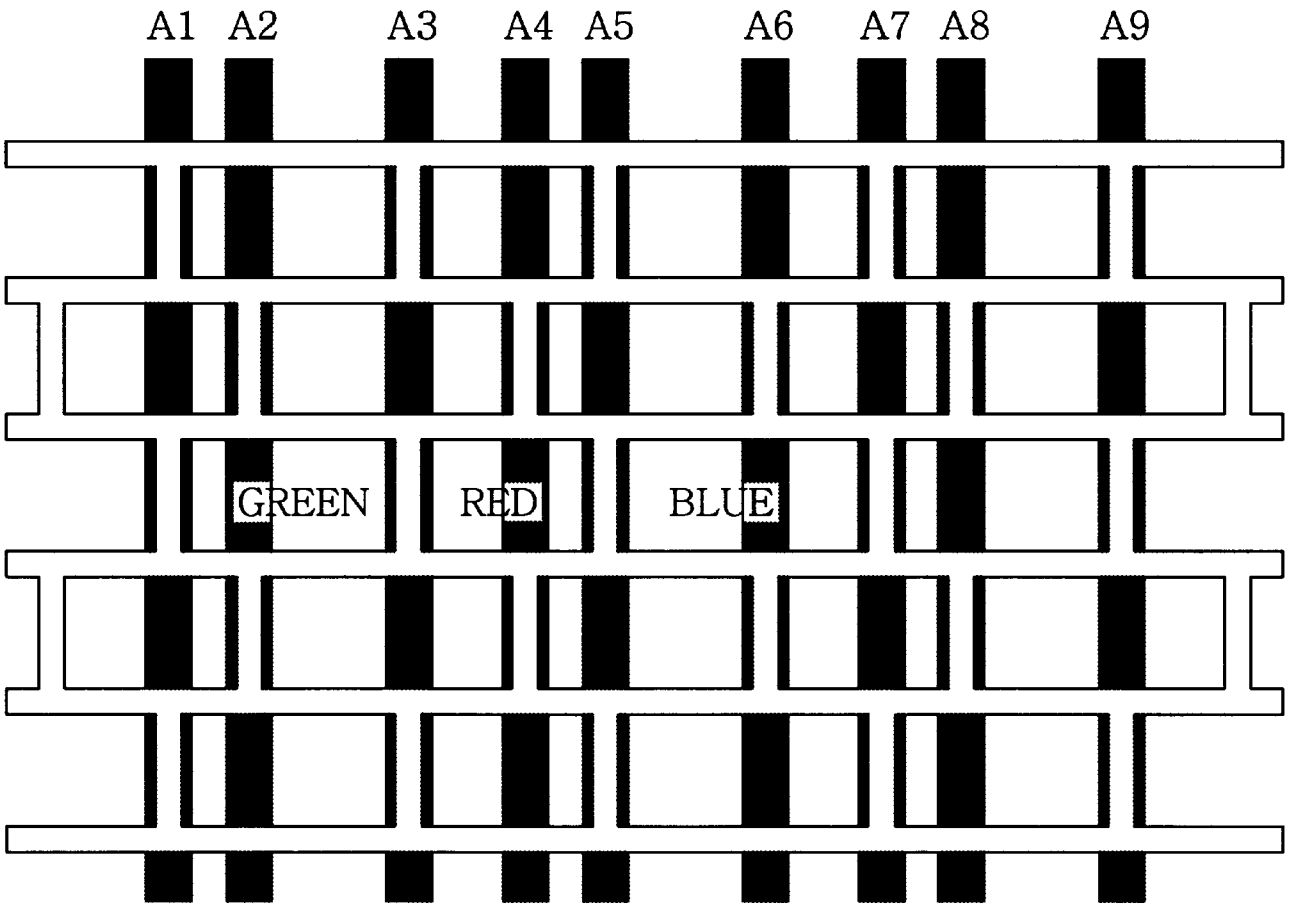
FIG. 12 is a plan view showing an AC PDP having different sizes of the RGB sub-pixels in accordance with a second embodiment of the present invention.

As depicted in FIG. 12, the column barrier rib of a blue phosphor-coated sub-pixel opposite to the red phosphor-coated sub-pixel is moved towards the red sub-pixel by 100 to 150 $\mu$m, making the sizes of those two sub-pixels different. As a matter of course, address electrodes A2, A5 and A8 should be correspondingly located under the newly designed column barrier ribs and the sustain electrodes formed on the front substrate should be suitably designed in accordance with the sizes or the shape of the newly designed blue and red sub-pixels.

In this embodiment, the green sub-pixels may be substituted for the red sub-pixels and vice versa.

[Third embodiment]

The inventors confirmed that variation of the lengths of the sustain electrodes depending on the kinds of the phosphors coated in the sub-pixels could obtain the same effects as the AC PDPs of the second embodiment of the present invention with the different lengths of the red and blue sub-pixels, as the AC PDP of the present invention has a structural advantage of a relatively great length of the RGB sub-pixels along which discharge occurs.

As shown in FIG. 8, in the AC PDP of the present invention, if the length of sustain electrodes is increased, the absolute luminance of the AC PDP is also increased in proportion to the increase of the length. That means the color temperature of the AC PDP can be raised without a decrease in white luminance, taking advantage of the above characteristics.

Figure 7A:
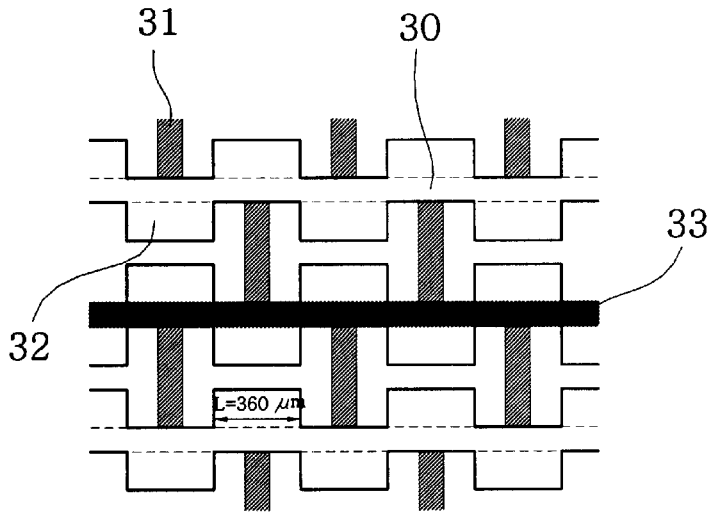
FIGS. 7A to 7D are plan views showing the examples of the AC PDP of the first embodiment with varying lengths of the sustain electrodes.
Figure 7B:
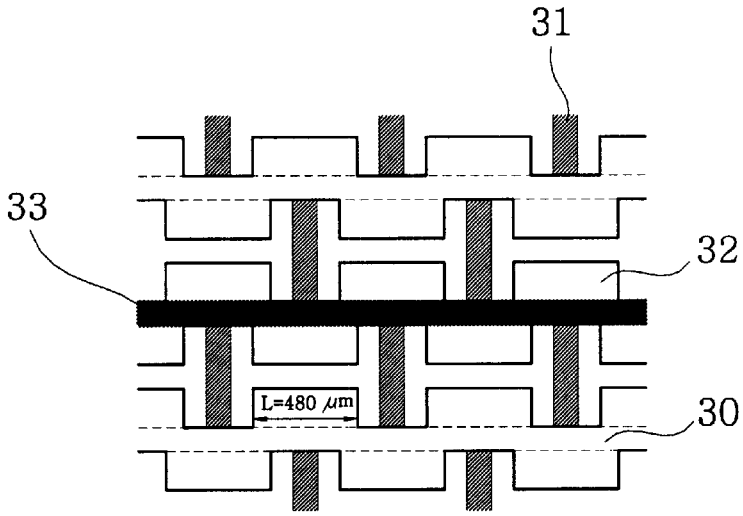
Figure 7C:
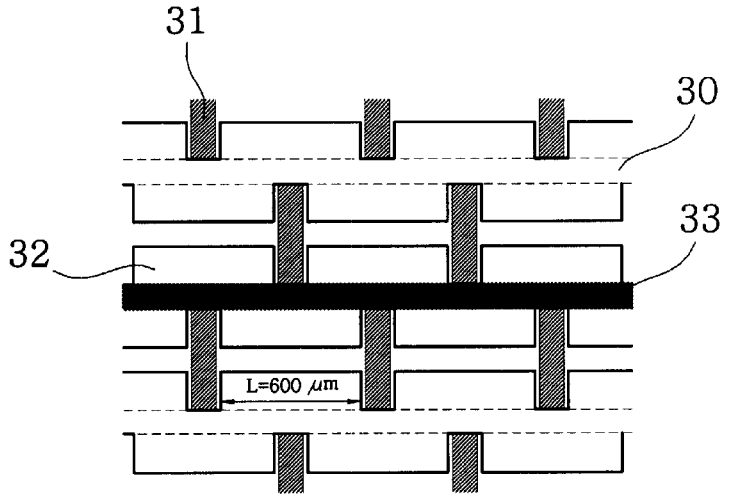
Figure 7D:
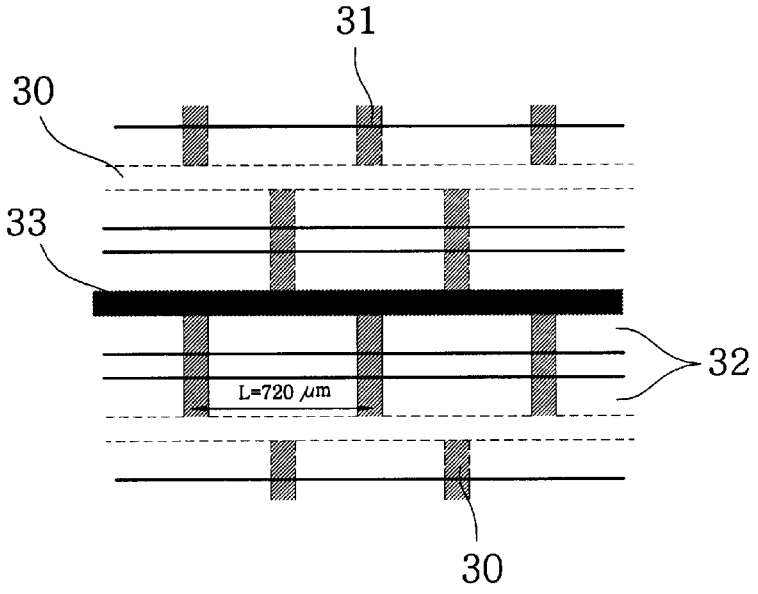
Figure 13:
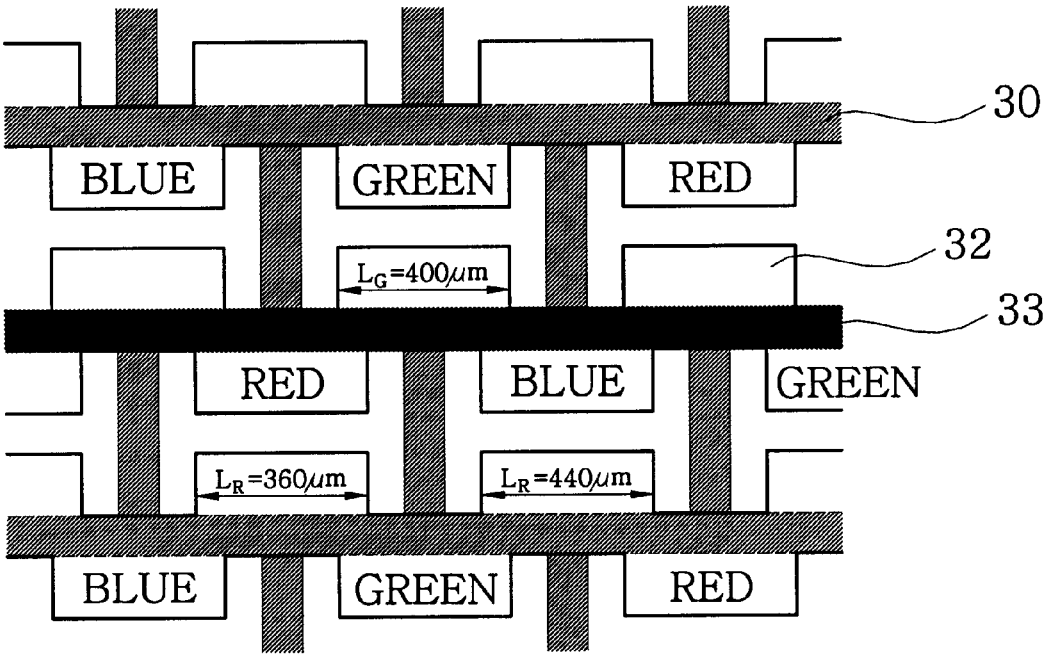
FIG. 13 is a view showing a AC PDP according to a third embodiment of the present invention in which the lengths of sustain electrodes vary according to the kinds of phosphors coated in the sub-pixels.

FIG. 13 is a plan view of the rear substrate of the AC PDP according to a third embodiment of the present invention, showing the construction of sustain electrodes in comparison with the panel D in FIG. 7A. In FIG. 13, while the length of sustain electrodes over the red phosphor-coated sub-pixel is not changed, the length of sustain electrodes over green and blue phosphor-coated sub-pixels are extended to 400 $\mu$m and 440 $\mu$m from 360 $\mu$m, respectively. It is preferable that the length of sustain electrodes over the green and blue phosphor-coated sub-pixels are respectively extended to 110 and 120% of the those over red phosphor-coated sub-pixels. The precise ratio of the lengths should be determined depending on the kinds of the phosphors and discharging characteristics.

The advantages of this embodiment are that lowering of color temperature in white luminance can be avoided by increasing the length of sustain electrodes over the green and blue phosphor-coated sub-pixels of low luminance and that the same rear substrate in FIG. 7 may be used.

Although three preferred embodiments of the present invention have been described for the sub-pixel spaces and RGB sub-pixels in the rectangular shape as an example of the closed shapes it's beyond doubt that the present invention shall cover and extend to the AC PDPs comprising the sub-pixel spaces of the closed shape such as square or hexagon and the correspondingly designed sustain electrodes and/or address electrodes. The hexagon shaped sub-pixel spaces may be defined by three pairs of parallel barrier ribs arranged one after the other.

As described above, the present invention provides an AC PDP which comprises the closed shape phosphor-coated sub-pixels (spaces) without any change in their absolute area and the corresponding sustain electrodes, thereby improving the absolute luminance and discharge efficiency of the AC PDP at the same time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An AC plasma display panel having delta color pixels of closed shape sub-pixels, comprising; a rear substrate formed with separated sub-pixel spaces defined thereon by closed shape barrier ribs for making color pixels respectively composed of three sub-pixels of red, green and blue phosphor layers disposed in a delta configuration in those sub-pixel spaces, and a front substrate formed with sustain electrodes having projections or wings respectively sticking out or extended over each sub-pixel to face a wing of the neighboring sustain electrode.

2. An AC plasma display panel as claimed in claim 1, wherein said sub-pixel spaces respectively have a rectangular shape defined by row barrier ribs arranged in parallel to each other and column barrier ribs arranged in parallel to each other to perpendicularly intersect said row barrier ribs.

3. An AC plasma display panel as claimed in claim 1, wherein said sub-pixel spaces respectively have a hexagon shape defined by three pairs of parallel barrier ribs arranged one after the other.

4. An AC plasma display panel as claimed in claim 2 or 3, further comprising address electrodes, formed on said rear substrate, each part of which passing under said sub-pixel spaces has a width three to ten times as broad as that of other parts passing under said barrier ribs and being covered by them so as not to affect the adjacent sub-pixels.

5. An AC plasma display panel as claimed in claim 1, 2 or 3, characterized in that said sustain electrodes have T-shaped wings, thereby length of the part of said electrodes along which discharge occurs is maintained and size of said electrodes is reduced.

6. An AC plasma display panel as claimed in claim 1, 2 or 3, characterized in that each of said sustain electrodes is formed by being laterally extended from an opaque rectangular bus electrode with the thickness of around 40 $\mu$m.

7. An AC plasma display panel as claimed in claim 1, 2 or 3, characterized in that the horizontal length of each of said blue sub-pixels is longer than that of the laterally adjacent red or green sub-pixels.

8. An AC plasma display panel as claimed in claim 1, 2 or 3, characterized in that length of the wing of said sustain electrodes is a half or one thirds of the horizontal length of said sub-pixel spaces.

9. An AC plasma display panel as claimed in claim 8, characterized in that the length of the wing of said sustain electrodes varies depending on the kinds of phosphors disposed in the corresponding sub-pixel spaces.

10. An AC plasma display panel as claimed in claim 1, 2 or 3, characterized in that length of the wings of said sustain electrodes for the blue or green sub-pixels is longer than that of the red sub-pixels.

11. An AC plasma display panel as claimed in claim 10, characterized in that lengths of the wings of said green and blue sub-pixels are respectively around 110% and 120% of that of said red sub-pixels.

* * * * *

UNITED STATES PATENT AND TRADEMARK OFFICE

CERTIFICATE OF CORRECTION

PATENT NO. : 6,373,195 B1
DATED : April 16, 2002
INVENTOR(S) : Ki Woong Whang et al.

It is certified that error appears in the above-identified patent and that said Letters Patent is hereby corrected as shown below:

Column 8,
Line 37, "a half or one thirds" should read -- a half to two thirds --

Signed and Sealed this

Seventeenth Day of February, 2004

JON W. DUDAS
*Acting Director of the United States Patent and Trademark Office*